United States Patent [19]

Karklys

[11] 3,986,372

[45] Oct. 19, 1976

[54] APPLIANCE PROGRAMMER INCLUDING A SAFETY CIRCUIT

[75] Inventor: Joseph Karklys, St. Joseph, Mich.

[73] Assignee: Whirlpool Corporation, Benton Harbor, Mich.

[22] Filed: Jan. 16, 1976

[21] Appl. No.: 649,805

[52] U.S. Cl. ..... 68/12 R; 68/207; 68/208; 307/141

[51] Int. Cl.[2] ..... D06F 33/02

[58] Field of Search ..... 68/12 R, 207, 208; 307/141, 141.4; 134/57 D; 137/387

[56] References Cited

UNITED STATES PATENTS

| | | | |
|---|---|---|---|
| 3,477,258 | 11/1969 | Walker et al. | 68/12 R |
| 3,707,856 | 1/1973 | Niewyk et al. | 68/12 R |
| 3,774,056 | 11/1973 | Sample et al. | 307/141 X |
| 3,783,651 | 1/1974 | Karklys | 68/12 R |

*Primary Examiner*—Philip R. Coe
*Attorney, Agent, or Firm*—James S. Nettleton

[57] ABSTRACT

An appliance programmer, in particular an automatic washer programmer, employs a memory circuit and a sequence control for establishing a predetermined program. Included in the programmer are a safety circuit and a water level sensing circuit whose function is to detect malfunction in the filling and draining operations of the appliance. Thus, when the machine has progressed to a washing operation during which the wash tub normally has a sufficient amount of water to perform the washing operation, the sensing circuit will sense a low water level condition and will reenergize the water fill valve solenoid to bring the water level up to the desired point. The programmer logic permits the safety circuit to reenergize the fill valve solenoid twice in response to low water level indications after which the logic will interrupt the program in response to a third low water level indication and will deenergize the appliance. In addition a service light is energized to call attention to the malfunction by the machine operator. Another portion of the safety circuit interrupts the program and deenergizes the machine function and energizes a service light when water is detected in the machine tub at the end of a draining operation.

10 Claims, 4 Drawing Figures

APPLIANCE PROGRAMMER INCLUDING A SAFETY CIRCUIT

CROSS-REFERENCE TO RELATED APPLICATIONS

This application is related to my co-pending applications, Ser. No. 506,838 and Ser. No. 506,792.

BACKGROUND OF THE INVENTION

1. Field of the Invention

This invention relates to an appliance programmer and is more particularly concerned with safety circuits to prevent overfilling and subsequent flooding of the appliance as well as other malfunctions of the appliance.

2. Description of the Prior Art

United States Letters Pat. No. 3,774,056 discloses a programmer for an appliance, in particular a dishwasher, in which a water level sensor is directly connected to the control logic circuit and provides for delay in the clock cycle while the tub is being filled. In addition if water continues to enter the vat after a fill event is completed, the overfill protection logic locks the control logic circuit into the pump-out cycle. Mechanical failures of the water valve solenoids, failure of the control logic or failure of the interfacing devices will eventually show up in that water is present in the tub, whereupon the overfill protection logic will cause the control logic to enter the pump-out cycle. At the same time the first wash light is caused to blink continuously thus calling attention to the fact that a failure has occurred. However, this patent does not disclose the simultaneous direct connection of the water level sensing switch to both the water fill valve solenoid and the control circuit. In addition, it does not show the use of an overfill protection circuit including a counter wherein, when an insufficient water level is detected during a washing operation, the water fill valve can be actuated a predetermined number of times to bring the water in the vat up to a desired level after which the program is interrupted and a service light is energized.

United States Letters Pat. Nos. 3,477,258 and 3,707,856, both of which are assigned to Whirlpool Corporation the assignee of record in the present application, show electronic programmers for automatic washing machines which include water level sensors.

SUMMARY OF THE INVENTION

An object of the present invention is to provide an electronic control for an appliance including a safety circuit which detects malfunctions in the water fill and drain portions of the machine and thereupon interrupts the program and deenergizes the washing machine.

Another object of the invention is to provide a programmer for an automatic washer as set forth above wherein the water level sensing switch is directly connected to both the water fill solenoid and the electronic control whereby the switch either completes the water fill solenoid circuit or completes a circuit to the electronic control.

Another object of the invention is to provide an appliance programmer as set forth above wherein a water fill safety circuit enables the water fill circuitry when an insufficient water level is detected during a washing operation in order to bring the water up to the desired level. A counter counts the number of times the water fill circuit is reenergized and after a predetermined number of times deenergizes the appliance.

Another object of the invention is to provide an appliance programmer wherein a service light is provided which is energized when a malfunction has been detected.

Another object of the invention is to provide an appliance programmer wherein a drain safety circuit is provided which deenergizes the appliance and turns on the service light when water has not drained completely from the wash tub at the termination of a drain operation.

According to the invention an appliance programmer, herein disclosed in the environment of an automatic washer, comprises a clock for supplying electrical pulses at discrete time intervals, a sequence control for establishing a sequence of appliance operations and a read-only memory circuit connected to the clock and to the sequence control for providing a sequence of output signals corresponding to the desired program. Power circuits are provided and are connected by means of appropriate interfacing circuits to the memory circuit. A water level sensing circuit including a water level sensing switch is connected to the power circuit and to an input circuit and a safety circuit. The safety circuit is connected to the sequence control, the water level sensing circuit and the memory circuit. The safety circuit, in response to inputs from the memory and the water level sensing circuit, provides outputs to the sequence control to interrupt the machine program and to energize a service light when a malfunction is detected.

The fill safety circuit comprises a counter and several NOR gates whereby the fill circuit can be energized twice upon detection of an insufficient water level during a wash operation. Upon a third detection of an insufficient water level the appliance is deenergized and the service light is energized.

The drain safety circuit consists of NOR gates and flip-flops whereby, when water is detected in the washtub at the end of a drain operation, the appliance is deenergized and the service light is energized.

BRIEF DESCRIPTION OF THE DRAWINGS

Other objects, features and advantages of the invention its organization, construction and operation will be best understood from the following detailed description taken in conjunction with the accompanying drawings in which.

DESCRIPTION OF THE PREFERRED EMBODIMENTS

Figure 1:
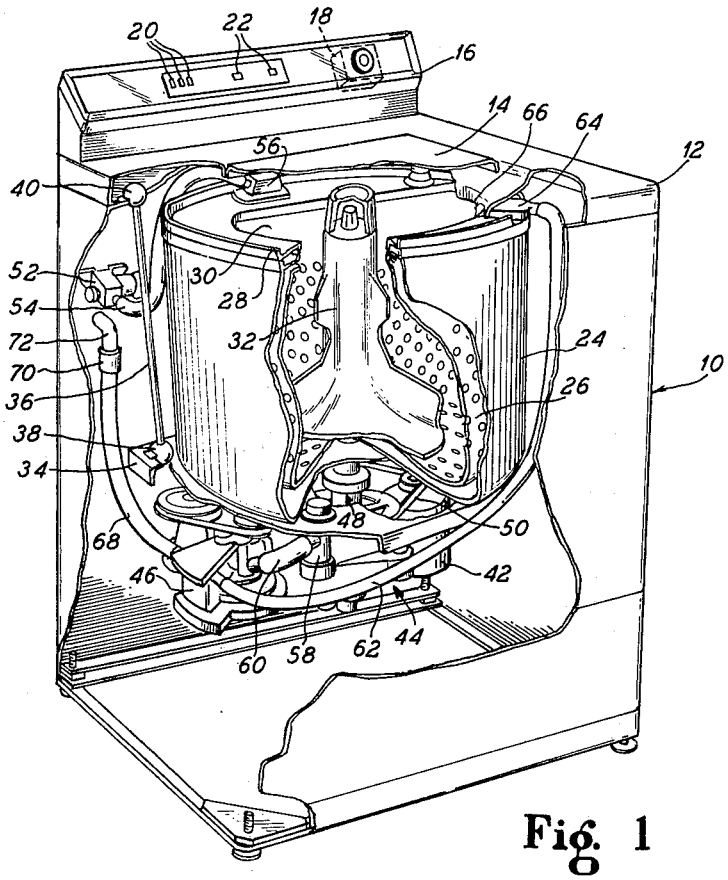
FIG. 1 is a perspective cut-away view of an automatic washer which may embody the programmer of the present invention.

The automatic washer as illustrated in FIG. 1, comprises a cabinet 10 including a cabinet top 12 having a lid 14 and a console 16. The console 16 is provided with a programmer 18, a plurality of operator controls 20, and a plurality of indicator lamps 22 to monitor the operation of the washer. One of the indicator lamps 22 is a service indicator light as will be discussed in more detail hereinafter. The operations controlled by the programmer 18 include a filling operation in which the tub 24 is filled with water to a desired level, a washing operation in which the clothes are agitated to remove soil, a draining operation in which the washing liquid is removed from the machine, and a spinning or extraction operation in which the clothes are centrifuged to remove more liquid from the fabric.

The tub 24 has a concentric perforate basket 26 therein for receiving clothes to be washed. A tub ring 28 is provided to prevent water from splashing over the top of the tub. The tub ring 28 is provided with an opening 30 through which clothes are received into the basket 26. An agitator 32 is provided within the basket 26 to impart a washing action to the clothes. The tub 24 is supported by a base plate 34 which is suspended from the cabinet 10 by three suspension rods, rod 36 being the only such rod illustrated. The rod 36 is connected to the base plate 34 by a resilient member 38 and to the cabinet 10 by a resilient member 40.

A motor 42 and a transmission 44 are suspended from the base plate 34 and provide means for driving the agitator 32 and the basket 26. A valve pump 46 is provided to circulate the washing liquid during the washing operation and to remove the liquid from the tub 24 during the draining and spinning operations. A clutch and brake assembly indicated at 48 allows for engagement of the agitator 32 for oscillatory motion during the washing operation, while holding the basket 26 stationary and for disengagement of the agitator 32 and engagement of the basket 26 for spinning of the basket during the spinning operation. The transmission 44, the pump 46, and the clutch and brake assembly 48 are driven by the motor 42 by means of a drive belt 50.

Water flows into the machine through a programmer controlled solenoid valve 52, a conduit 54 and an anti-siphon device 56 into the tub 24. A water level sensing switch 160 (FIG. 4) is used to sense when sufficient water has entered the tub to deenergize the solenoid of valve 52. The water level sensing switch operates on the water pressure principle and its method of operation does not form a part of the present invention but is well-known to those skilled in the art. During the washing operation washing liquid is circulated from the tub 24 by pump 46 through a button trap 58, a conduit 60, and a conduit 62 to a filter 64. The water flows through the filter where particles such as lint are removed and the filtered water flows through the discharge end of the filter into the basket 24 through the tub ring opening 30. The filter is mounted through a vertical flange 66 of the top 12 so as to overhang the opening 30. During draining of the tub 24 the pump valve is operated and washed liquid flows from the tub 24 through the button trap 58 and the conduit 60 to the pump 46. The wash liquid is then pumped through a conduit 68, a check valve 70 which allows flow of liquid in this direction only and a conduit 72 to a drain (not shown).

Figure 2:
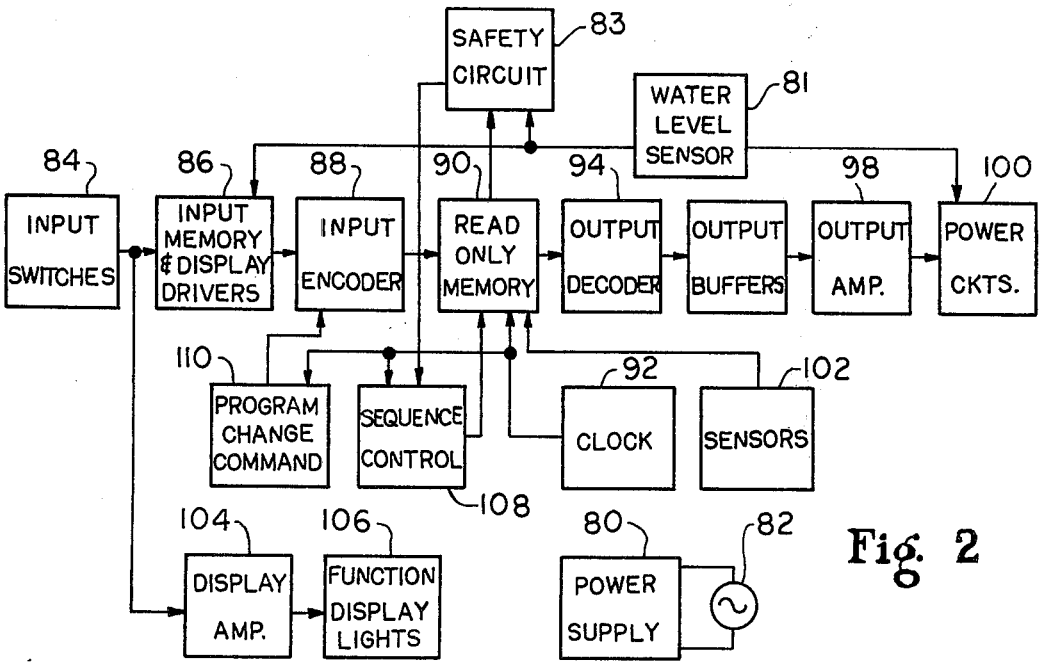
FIG. 2 is a schematic block diagram of a programmer constructed in accordance with the present invention.

Referring to FIG. 2, a schematic block diagram of the programmer 18 is generally illustrated as comprising a power supply 80 which is connected to a commercial electrical supply 82 such as 125 vac, 60 Hz. The individual power connections to the individual circuits have been omitted for the sake of clarity. It is however well-known in the art to derive timing pulses and establish a program sequence with clock pulses derived from the commercial line supply.

The program comprises a number of program steps which consist of filling, washing, draining and spinning functions, the duration of each of which is either controlled by the clock or by the sensors. An operator may elect to eliminate certain ones of the program steps and for this purpose several operator switches 84 are provided which, when depressed at the proper time, will alter the basic cycle. This is further described in my above-identified patent application, Serial No. 506,838. The switches 84 are connected to an input memory and display driver circuit 86 which stores the information regarding the desired program modification. The input memory is connected to an input encoder 88 which provides a specified output for certain combinations of inputs. By way of example the input encoder may comprise a number of AND gates. The information from the input encoder is provided to a read-only memory 90 which by way of example, may comprise a matrix. The matrix provides outputs only for a predetermined number of inputs as is well-known in the art. Therefore, for example, when a specific input switch has been depressed, a sequence control 108 provides a certain output and a clock 92 provides a clock pulse, the read-only memory 90 will provide a specified output to an output decoder 94. The output decoder 94 is connected by way of output buffers 96 and output amplifiers 98 to a plurality of power circuits 100, hereinafter called output circuits, which perform the various operations of the program including the opening and closing of the valves for filling, draining and shifting for agitation and spin. The sequence control 108 is provided for establishing the sequence of steps in the operating cycle of the appliance. The sequence control can be constructed similar to that illustrated in United States Letters Pat. No. 3,662,186.

The read-only memory also receives inputs from sensors 102. The sensors may comprise, by way of example, a spin-dry sensor and a drain sensor such as are shown in the aforementioned United States Pat. No. 3,477,258. As mentioned above the read-only memory provides an output to an output decoder 94 which decodes the information of the read-only memory and feeds the same to output buffers from which the information is routed to the output amplifiers and the power circuits which operate the appliance. The automatic washer can also be provided with function display lamps to indicate the progression of the washing program. In the embodiment illustrated in FIG. 2 function display lights 106 are energized by display amplifier 104 which receives its input from the display drivers associated with the input memory 86. The display lights 106 may advantageously comprise light emitting diodes although other types of display lights may also be used. The function of display lights 106 is to indicate which machine functions have been selected by the operator by means of the input switches. The display lights may also be used to indicate the progression of the washing program. One of the display lights is used to indicate a malfunction of the machine and has been labeled "Service" and therefore functions as an alarm circuit.

So far the description hereinabove has only been concerned with circuits which are well-known in the art. In addition a water level sensor circuit 81 is shown which is connected to the power circuits and in particular to the solenoid which controls the water fill valve and to the input memory display drivers 86. In addition a safety circuit 83 is shown which is connected to the sequence controls and which receives inputs from the read-only memory 90 and the water level sensor circuit 81. These circuits 81 and 83 are described in greater detail in connection with FIG. 4.

Figure 3:
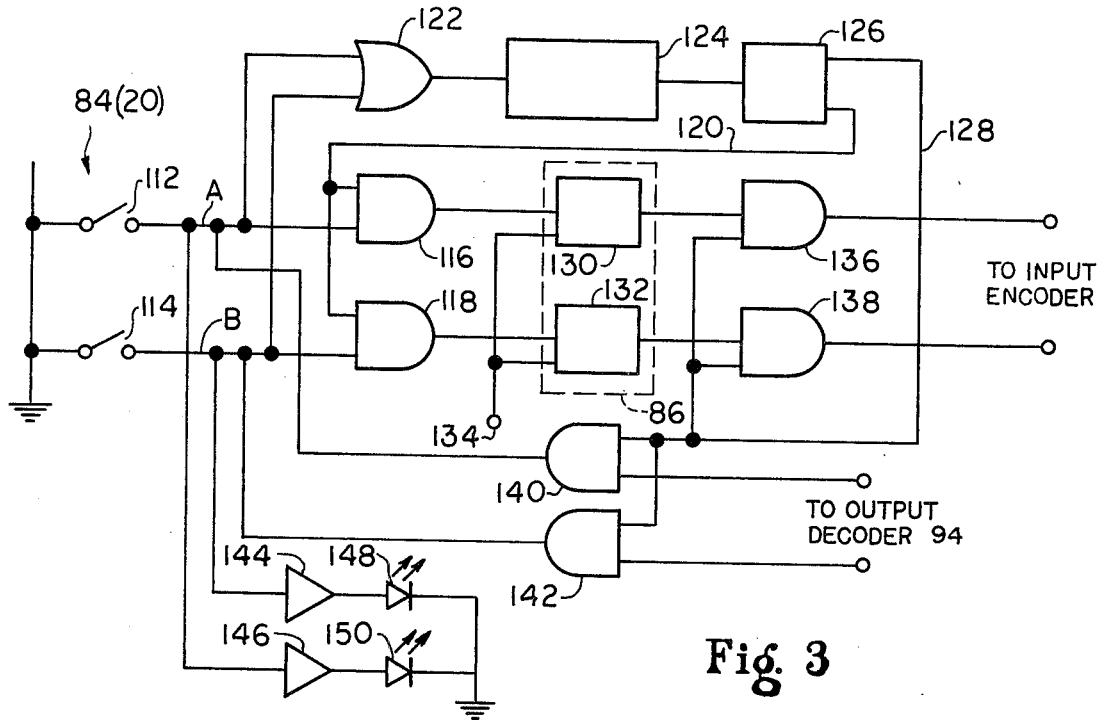
FIG. 3 is a schematic logic diagram of an operator controlled program modification circuit which may be employed in the circuit of FIG. 2.

Referring to FIG. 3, apparatus for operator controlled manual alteration of the program at the beginning of a cycle is illustrated. The purpose of this structure is to allow the operator to modify the basic program and to set aside a specified amount of time at the beginning of the cycle to do so. Once that amount of time elapses the programmer will lock out any further modifications selected by the operator. A timer is provided and each time the operator selects another option within the specified time the timer is reset and begins counting anew toward the specified amount of time. In FIG. 3 the input switches 84 have been illustrated in detail as comprising a pair of switches 112 and 114 which may be inexpensive momentary switches and which may be depressed by the operator to select the specific types of options. By way of example the operator may elect to skip specific steps in the program. By depressing the switches 112 and 114 respective inputs are applied to a pair of AND gates 116 and 118. The other inputs of these AND gates are connected to a flip-flop 126 and, until a reset pulse is received by the flip-flop 126, an output will appear which is fed to the gates 116 and 118. Therefore the gates 116 and 118 will produce an output which is fed to a pair of latch or memory circuits 130 and 132. These latches represent the input memory 86 of FIG. 2 and include a "clear" input 134 which is energized at the beginning of the program cycle. This may be a reset pulse from the clock such as by way of a single shot flip-flop. The outputs of the latches are provided to two AND gates 136 and 138 which also receive inputs from the reset side of the flip-flop 126 by way of a connection 28. The switches 112 and 114 are also connected to an OR gate 122 which provides a pulse to a timer 124 whenever one of the switches 112, 114 is actuated. Therefore the timer is reset each time one of the switches is actuated. If the timer is not reset for a period of eight seconds, for example, the timer will provide an output pulse which will reset the flip-flop 126 and remove the inputs supplied thereby to the AND gates 116 and 118 so that any further actuation of the switches 112 and 114 is locked out.

At this time however the AND gates 136 and 138 are opened by the signal on the reset output 128 of the flip-flop 126 to provide respective output pulses to the input encoder 88. The input encoder 88 processes information to alter the basic program of the appliance. The flip-flop 126 also provides inputs for a pair of AND gates 140 and 142 which receive respective inputs from the output decoder 94 corresponding to the altered sequence. The gates 140 and 142 drive the light emitting diodes 148 and 150 by way of respective amplifiers 144 and 146 to indicate progression of the altered program. It should be noted that the light emitting diodes 148 and 150 are energized by way of circuit connections of the integrated circuit which include portions A and B and which are shared with the connections of the operator switches 112 and 114.

Figure 4:
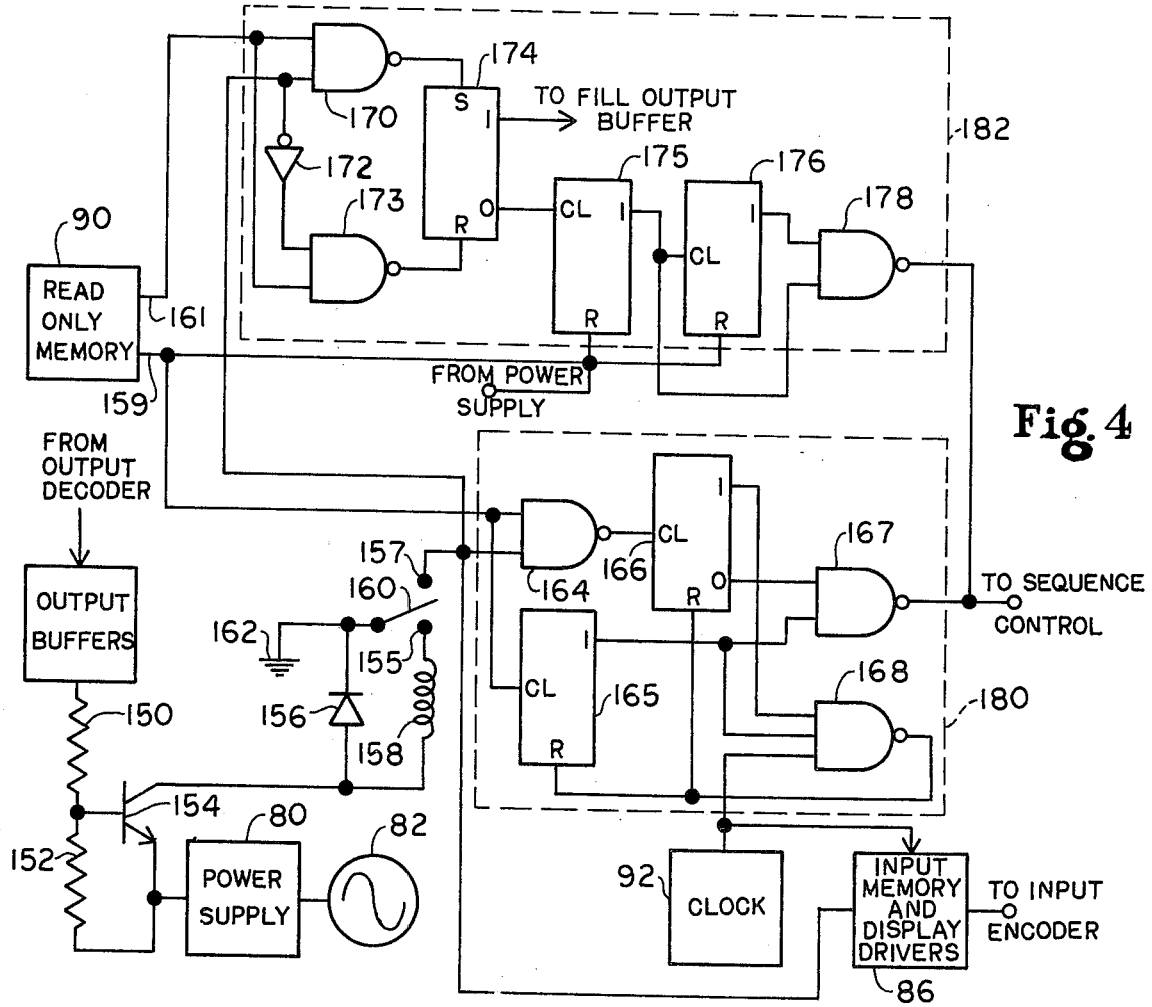
FIG. 4 is a schematic logic diagram of a water fill and drain safety circuit which may be employed in the circuit of FIG. 2.

Referring to FIG. 4 a transistor 154 is shown which controls the energization of the water fill valve 158. Transistor 154 is controlled from the output buffers by means of a resistor 150 connected to its base. A resistor 152 is connected from the base of the transistor to its emitter. The junction of the resistor 152 and the emitter of transistor 154 is connected to the power supply. The collector of the transistor is connected to one terminal of the water fill valve solenoid 158. The other terminal of the solenoid 158 is connected to a fixed contact 155 of single pole, double-throw switch 160. The switch blade of switch 160 is connected to a source of reference potential 162 here indicated as ground. A commutation diode 156 is connected from the collector of the transistor 154 to the source of reference potential. The diode prevents chattering of the water fill valve when it is energized. The other fixed contact 157 of switch 160 is connected to an input of NAND gate 164, an input of NAND 170 and to the input memory and display drivers 86. The inputs to NAND gates 164, 170 and 173 from the read-only memory 90 are biased internally to a positive voltage so that when the switch blade of switch 160 does not connect with contact 157 these inputs will have a high or 1 signal appearing thereon. For the sake of clarity these biasing connections have not been shown. However they will be apparent to anyone skilled in the art. The switch 160 is actuated by the water pressure in the washtub so that when sufficient water has entered the tub, the switch blade will transfer from contact 155 to contact 157 thereby deenergizing the water fill valve and giving a "full" indication to the safety circuit. The safety circuit 83 consists of two portions 180 and 182. Portion 182 comprises the water fill safety circuit. Portion 180 comprises the drain safety circuit.

Water fill safety circuit 182 consists of a NAND gate 170 which has an input from the switch 160 and from the agitator output 161 of read-only memory 90. An inverter 172 is connected from the input switch 160 to an input of the NAND gate 173. The agitator output of read-only memory 90 is also connected to the other input of NAND gate 173. The output of NAND gate 170 is connected to the set input of flip-flop 174 and the output of NAND gate 173 is connected to the reset output of flip-flop 174. The 1 output of flip-flop 174 is connected to the fill output buffer. The 0 output of flip-flop 174 is connected to the clock input of flip-flop 175. The reset input of flip-flop 175 is connected to the drain output 159 of read-only memory 90 and to the power supply. The 1 output of flip-flop 175 is connected to the clock input of flip-flop 176 and to an input of NAND gate 178. The reset input of flip-flop 176 is connected to the drain output 159 of read-only memory 90 and to the power supply. The 1 output of flip-flop 176 is connected to the other input of NAND gate 178. The output of gate 178 is connected to the sequence control.

Drain safety circuit 180 has a NAND gate 164 one input of which is connected to the drain output 159 of read-only memory 90 and the other input of which is connected to contact 157 of switch 160. A flip-flop 165 has a clock input connected to the drain output 159 of read-only memory 90. The output of NAND gate 164 is connected to the clock input of flip-flop 166. The reset input of flip-flops 165 and 166 are connected to an output of NAND gate 168. The 1 output of flip-flop 165 is connected to an input of NAND gate 168 and an input of NAND gate 167. The 0 output of flip-flop 166 is connected to another input of NAND gate 167. The 1 output of flip-flop 166 is connected to another input of NAND gate 168. A third input of NAND gate 168 is connected to the clock 92. The output of NAND gate 167 is connected to the sequence control.

The operation of the safety circuit is as follows: at the end of a drain operation a positive pulse will be provided at the drain output 159 of read-only memory 90. If the machine is operating correctly all the water will have drained from the tub at this time and the switch blade of switch 160 will have transferred from contact 157 to contact 155. However, if we assume that the machine is malfunctioning so that all the water will not have been pumped out of the tub, the switch blade will remain closed on contact 157. Thus, the inputs to NAND gate 164 are a 1 and a 0 thus causing a 1-state output for NAND gate 164. The output of NAND gate 164 is therefore not changed unless switch blade 160 transfers from contact 157 to contact 155. Therefore if the machine does not drain properly the outputs of flip-flop 166 remain unchanged and the 0 output of flip-flop 166 will remain at a 1-state. At the same time the pulse on the drain out-put 159 of read-only memory 90 will have toggled flip-flop 165 thereby providing a 1-state signal on its 1 output. The inputs to NAND gate 167 will therefore both be in the 1-state thereby providing a 0-state output pulse. This output pulse is routed to the sequence control thereby energizing the service light and inhibiting all machine functions. In other words, in response to the 0-state output signal of gate 167 the sequence control causes the read-only memory to produce the necessary outputs to energize the service light, and to cause the main relay coil to remain energized. Thus no other devices or coils will be energized and all other functions cease until the operator deenergizes the machine. The operator is thereby alerted that a malfunction has occurred. If the machine had operated properly the output of NAND gate 164 would have switched at the end of the drain operation and flip-flop 166 would have toggled so that NAND gate 167 would have had a 0 and 1 inputs so that its output would have remained a 1-state signal. When flip-flop 166 toggles so that a 1-state exists on its 1 output and a 1-state exists on the 1 output of flip-flop 165, the next clock pulse will cause the output of gate 168 to change thereby resetting flip-flops 165 and 166 so that the control is ready for the next machine cycle. It is thus seen that circuit 180 will deenergize the machine and will actuate the service light whenever the machine does not drain properly. This can occur due to a number of causes such as a restricted drain hose, a broken motor belt, contaminated water level switch contacts, open water level switch contacts, breaks in the water level switch ground connection, a defective motor, and many other causes. It can also be seen that since the water level switch is connected directly to both the fill valve and to the safey circuit additional safety is built in to the circuit as the very indication to the input memory by the water level switch that the machine has failed will at the same time deenergize the water fill solenoid.

Water fill safety circuit 182 operates as follows: If we assume that the machine program has progressed to the agitate operation so that the agitate output of read-only memory has a 1-state signal thereon and if we assume that the tub contains an insufficient amount of water so that the water level switch will not have transferred from contact 155 to contact 157 then NAND gate 170 will have two one inputs and will therefore generate a low output. At the same time due to inverter 172 the inputs to NAND gate 173 will be a 1 and a 0 thereby generating a 1-state output. Since the output of gate 173 does not change and the output of gate 170 does change flip-flop 174 will toggle and will produce a 1-state output on its 1 output terminal which is routed to the fill output buffer thereby reenergizing the water fill valve solenoid 158. When the switch blade 160 transfers to contact 157 due to a sufficient amount of water in the washtub, the output of gate 173 will change thereby resetting flip-flop 174. Therefore the signal on its 1 output terminal disappears thereby deenergizing the water fill valve solenoid. The pulse on its 0 output terminal will toggle flip-flop 175. If another failure occurs gates 170, 173, and 174 will repeat the above described steps. As flip-flop 176 toggles at the trailing edge of a pulse the change in outputs of gate 175 will cause flip-flop 176 to toggle. The inputs to gate 178 are therefore a 1 from flip-flop 176 and a 0 from flip-flop 175. Its output will therefore remain a 1-state. However, at the termination of the fill step as switch blade 160 transfers to contact 157 the output of gate 175 will change so that the inputs to gate 178 will both be 1-state signals thereby generating a low output which is routed to the sequence control thereby inhibiting all machine functions and turning on the service light as described above. It can therefore be seen that flip-flops 175 and 176 comprise a counter which allows the fill safety circuit to step back twice into the fill operation. It is, of course, understood that different counters could be provided to allow for a greater or lesser number of refills. Some of the malfunctions which will be detected by the fill safety circuit are leaky hoses, siphoning of water out of the machine, contaminated water level switch contacts, bad water level switch ground connection.

Although I have described my invention by reference to a particular illustrative embodiment thereof many changes and modifications of the invention may become apparent to those skilled in the art without departing from the spirit and scope of the invention. I therefore intend to include within the patent warranted hereon all such changes and modifications as may reasonably and properly be included within the scope of my contribution to the art.

Having described the invention of the embodiments of the invention in which an exclusive property or privilege is claimed are defined as follows:

1. In an automatic washing appliance including a wash tub and an electronic control for stepping the appliance through an operating program comprising a sequence of operations, said control comprising;

a clock for supplying electrical pulses at discrete time intervals;

a memory circuit connected to said clock and said sequence control for generating a sequence of output signals;

a plurality of output circuits connected to said memory circuit and including a water fill circuit, said output circuits performing said operations in response to said output signals;

an overfill protection circuit connected to said sequence control and said memory circuit;

a water level sensing circuit connected to said water fill circuit and said protection circuit;

whereby when said sensing circuit detects an insufficient water level in the tub during a washing operation said water fill circuit is reactivated to supply additional water until said sensing circuit is satisfied.

2. An appliance according to claim 1 wherein said overfill protection circuit includes a counter for counting the number of times said water fill circuit is reactivated.

3. An appliance according to claim 2 wherein said program is interrupted and said appliance is deactivated when said counter has reached a count of two.

4. The appliance according to claim 1 and including an alarm circuit which is energized when said water fill circuit has been reactivated a predetermined number of times.

5. The appliance according to claim 1 wherein said water level sensing circuit includes a single pole double throw switch, and said water fill circuit includes a solenoid, said switch having one fixed contact connected to said solenoid and another fixed contact connected to said overfill protection circuit.

6. The appliance according to claim 1 and including a drain protection circuit for interrupting said program and deactivating said appliance when said sensing circuit detects an excessive water level at the termination of a drain operation.

7. In an automatic washing appliance including a wash tub and an electronic control for stepping the appliance through an operating program comprising a sequence of operations, said control comprising:

a clock for supplying electrical pulses at discrete time intervals;

a sequence control for establishing said sequence of appliance operations;

a memory circuit connected to said clock and said sequence control for generating a sequence of output signals;

a plurality of output circuits connected to said memory circuit including a water fill circuit comprising a solenoid actuated valve, said output circuits performing said operations in response to said output signals;

a drain protection circuit connected to said sequence control and said memory circuits;

a water level sensing circuit including a single pole double throw switch having one fixed contact connected to said solenoid and another fixed contact connected to said drain protection circuit whereby when said sensing circuit detects the presence of water in said tub at the termination of a drain operation said program is interrupted and said appliance is deenergized.

8. An appliance according to claim 7 and including an overfill protection circuit connected to said memory circuit and said sequence control, whereby when said sensing circuit detects an insufficient water level in the tub during a washing operation said solenoid is reenergized until sufficient water has entered the tub to satisfy said sensing circuit.

9. The appliance according to claim 8 wherein said overfill protection circuit includes a counter.

10. The appliance according to claim 9 wherein said counter counts the number of times said solenoid is reenergized during said washing operation and said program is interrupted and said appliance is deactivated when said counter has reached a predetermined count.

* * * * *